United States Patent [19]

Maasberg

[11] 4,168,562

[45] Sep. 25, 1979

[54] SURFACE-CLEANING APPARATUS

[75] Inventor: Wolfgang Maasberg, Hünxe, Fed. Rep. of Germany

[73] Assignee: Woma-Apparatebau Wolfgang Maasberg & Co. GmbH, Duisburg, Fed. Rep. of Germany

[21] Appl. No.: 867,507

[22] Filed: Jan. 6, 1978

[30] Foreign Application Priority Data

Jan. 8, 1977 [DE] Fed. Rep. of Germany ..... 2700595

[51] Int. Cl.[2] ..... A47L 7/00

[52] U.S. Cl. ..... 15/320; 15/322; 15/340; 15/354

[58] Field of Search ..... 15/320, 321, 322, 340, 15/345, 346, 354, 361

[56] References Cited

U.S. PATENT DOCUMENTS

| | | | |
|---|---|---|---|
| 948,164 | 2/1910 | Dougherty | 15/354 X |
| 2,497,435 | 2/1950 | Branneman | 15/321 X |
| 3,161,900 | 12/1964 | Hornschuch et al. | 15/345 |
| 3,663,984 | 5/1972 | Anthony et al. | 15/321 |
| 3,959,010 | 5/1976 | Thompson et al. | 15/320 X |
| 4,023,233 | 5/1977 | Prestwich | 15/320 |

FOREIGN PATENT DOCUMENTS

| | | | |
|---|---|---|---|
| 95877 | 4/1960 | Norway | 15/321 |
| 1159057 | 7/1969 | United Kingdom | 15/320 |

*Primary Examiner*—Christopher K. Moore
*Attorney, Agent, or Firm*—Karl F. Ross

[57] ABSTRACT

A surface-cleaning apparatus, especially for street cleaning and the cleaning of industrial surfaces, comprises an array of high-pressure water nozzles surrounding a pick-up nozzle whose open end is formed with a flow accelerating hood, the pressure nozzle surrounding this hood being constituted as drive nozzles whose water sprays are trained beneath the collecting nozzle. The collecting nozzle is connected to a suction source which draws the dirty water upwardly after the water is reflected from the surface to be cleaned. The device is mounted upon a vehicle or is displaceable by a vehicle.

8 Claims, 3 Drawing Figures

SURFACE-CLEANING APPARATUS

FIELD OF THE INVENTION

The present invention relates to a surface-cleaning apparatus and, more particularly, to a water pick-up arrangement for training high-pressure water streams upon a surface to be cleaned and a suction-type pick-up or vacuum cleaner for recovering the dirty water from the surface.

BACKGROUND OF THE INVENTION

For the cleaning of streets and other surfaces, e.g. the floors of industrial plants, it has been proposed heretofore, by myself and others, to train jets of high-pressure water upon the surface and to collect the reflected dirty water in a trough. The dirty water is generally filtered and recirculated to the aforementioned jets.

The jets are generally operated at extremely high pressure, e.g. up to several hundred Bars.

To pick up the dirty water in the conventional processes, the aforementioned troughs are used, the water entering these troughs primarily by reflection from the surface. In practice it has been found that this technique does not avoid water losses. To reduce the water losses, it has been proposed to substitute for the aforementioned collection troughs, suction devices and associated suction funnels which can be connected to the dirty water recovery duct. In such systems, the pressurized-water nozzles generally train the respective water streams beneath the suction funnel.

In practical embodiments of such apparatus, the pressurized-water nozzles are disposed, with respect to the direction of travel of the vehicle, behind the suction funnel while ahead of the suction funnel there is provided means for generating an air curtain. The compressed air nozzles which serve for this purpose produce a barrier for wayward reflected water and for the dirty water.

In another construction, the pressurized-water nozzles can be oriented ahead of the suction funnel, usually beneath a covering tunnel. Even with the latter construction, however, and in spite of the pressurized-air curtain or lock and the covering tunnel, the water losses are found to be relatively high and the suction effect for intensive cleaning is not entirely satisfactory.

OBJECT OF THE INVENTION

It is the object of the present invention to provide a suction-type surface cleaner, especially as a vehicle or a cleaning device displaceable by a vehicle, which has a reduced water loss and optimum cleaning effectiveness.

SUMMARY OF THE INVENTION

This object and others which will become apparent hereinafter are attained, in accordance with the present invention, in a suction-type surface cleaning apparatus which is mounted upon or forms part of a vehicle or which is displaceable on or by a vehicle, which has the extremely low water loss mentioned previously as well as an optimum cleaning effectiveness, and which is especially dust free and thus is highly advantageous for avoiding environmental pollution and ensuring relatively deep cleaning, i.e. penetrating pores of the surface to be cleaned.

According to the invention, the suction-type cleaner is provided with a dirty-water withdrawal duct which is surrounded by the pressurized-water nozzles and has, at its downwardly open end, a flow-accelerating collection nozzle through which the dirty water and entrained air are accelerated. According to a feature of the invention, the pressurized-water nozzles are constituted as a drive nozzle whose pressurized-water jets or streams are trained beneath the collecting nozzle. The dirty water reflected from the surface to be cleaned is sucked into the dirty water removal duct and is carried away.

The vehicle can be provided with a suction pump connected with the collecting duct, a storage tank in which the contaminants settled or filtered from the water are collected, and a high-pressure pump connected to the drive nozzle.

The combined effects of the propellant or drive nozzle and the flow-accelerating collecting nozzle constitutes of the apparatus an ejector-type pump which increases the recovery of water from the surface to be treated. In other words, the recovery of water from the surface is no longer only a result of the suction effect or a result only of the reflected water recovery, but rather both the reflection and suction effects are sharply augmented by the ejector-pump principle.

Surprisingly, the effect of removal of water from the surface to be cleaned is significantly greater than that obtained with suction alone or by prior reflective-water collections, even using higher pressure streams of water.

In addition, the ejector principle under which the system operates, creates a soil-loosening impulse effect at the point at which the pressurized-water stream are reflected from the surface.

This is indeed surprising because, in spite of the fact that the pressurized-water streams are trained practically in opposition to one another, there are no detrimental hydrodynamic effects. The cleaning efficiency is sharply increased over conventional systems using water jets at the same pressure and vacuum arrangements capable of developing the same level of suction.

Indeed, it is possible to operate without auxiliary suction using exclusively the ejector or Venturi action mentioned previously.

It has been found to be advantageous to mount the pressurized-water nozzles by universal joints upon a common support so that the angle included between the axes of the respective jets and the surface can be adjusted within a wide range, preferably, between 30° and 75°.

Because of the adjustability of the angle included between the pressurized-water jets and the surface or/and the angular spread or apex angle of the conical jet itself, it is possible to adjust the orientations of the respective pressurized-water jets in accordance with the dimensions of the collecting nozzle and the distance between this collecting nozzle and the surface to be cleaned.

Preferably, the pressurized-water nozzles are disposed along a circle around the dirty-water withdrawal duct and are equidistant from one another, i.e. the nozzles are angularly equispaced about the axis of this duct.

The nozzles are preferably trained inwardly and downwardly against the surface to be cleaned and the pressurized-water streams from the various nozzles meet centrally beneath the collecting nozzle.

Advantageously, the pressurized-water jets and the open end of the water-withdrawal duct with its collecting nozzle are enclosed in a downwardly open hood which, around the region to be cleaned, is formed with elastic sealing strips in contact with the surface. This has been found to further reduce the losses of the washing water.

According to still another feature of the invention, the collecting nozzle lies at an adjustable distance from the surface and preferably the collecting nozzle can be vertically shifted along the duct. This adjustability feature for, on the one hand, the pressurized-water nozzles and hence the propellant nozzle of the ejector and, on the other hand, the collector nozzle, ensures optimum suction effect and intensive cleaning.

Independently therefrom, the principal advantage of the system of the present invention is that it is able to achieve effective recovery of the water from the surface to be cleaned, and improved cleaning of the surface, without the need for additional high-vacuum suction devices. The cleaning operation is totally dust free and the penetration of the cleaning action into the pores of the surface is ensured. The apparatus of the present invention is thus not only simpler and less expensive than prior systems for surface cleaning, but the entire system is both technologically and environmentally advantageous.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
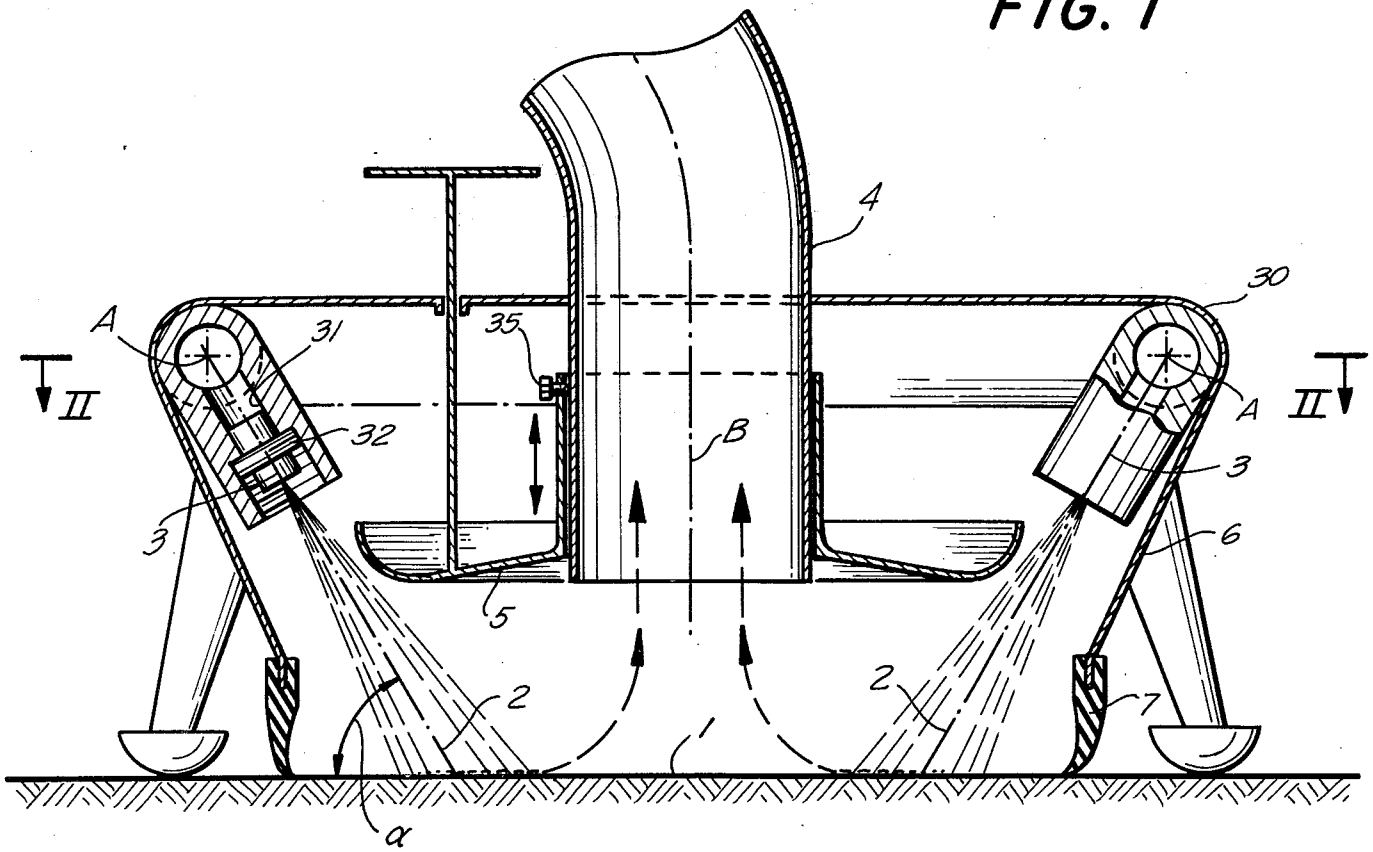
FIG. 1 is a schematic vertical cross section through the washing apparatus of the present invention.
Figure 2:
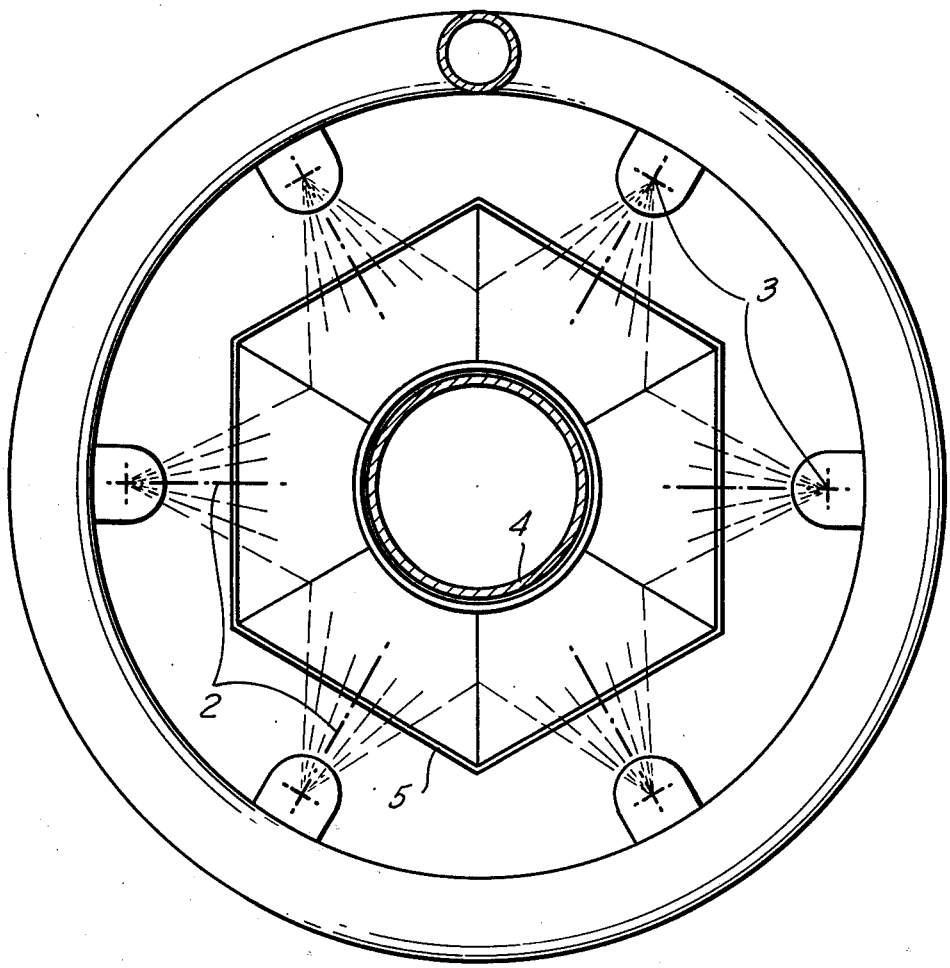
FIG. 2 is a cross-sectional view taken along the line II—II of FIG. 1.

In FIGS. 1 and 2 of the drawing, I have shown a surface cleaning apparatus which can form part of a vehicle or can be mounted thereon and is intended for the cleaning of streets or like surfaces 1 with high-pressure water streams 2 which can have a pressure, at the respective nozzle outlets, of several hundred Bars.

The apparatus basically comprises a circular distributing tube or manifold 30 which is provided with a multiplicity of high-pressure water nozzles 3 which can be swingable about respective axes A as shown, for example, in FIG. 1. Preferably, each of the nozzles 3 is connected by a cardan or universal joint with the manifold 30.

Each nozzle 3 can have a nozzle bore 31 in which an orifice disk 32 is threaded as has been shown for the left-hand nozzle in FIG. 1.

Centrally of the manifold 30, there is provided a large-diameter dirty-water-recovery duct 4 which lies along the axis B of the apparatus. The duct 4 is surrounded by the array of angularly equispaced pressurized-water nozzles.

The downwardly turned open end of the duct 4 is provided with a flow-accelerating collecting nozzle 5.

The pressurized-water nozzles 3 form a propulsion nozzle whose pressurized-water jets 2 are trained beneath the collecting nozzle 5. The dirty water from the surface against which the jets are trained is drawn upwardly and away from this surface as represented by the arrows by a combined ejector and Venturi action.

The nozzles 3 are adjustable so that the angle $\alpha$ which the respective axes make with the surface 1 can be varied between, for example, 30° and 75°.

The jets 2 meet centrally beneath the collecting nozzle 5. The nozzles 3 and the open end of the duct 4 with the collecting nozzle 5 are surrounded by a downwardly converging frustoconical hood 6 sealed against the surface 1 by elastic sealing strips 7. The nozzle 5 is shiftable relative to the duct 4 and the surface 1 to be cleaned and can be locked in place by screws as shown, for example, at 35. The duct 4 can be connected to a suction source which has been represented at 15 in FIG. 3.

Figure 3:
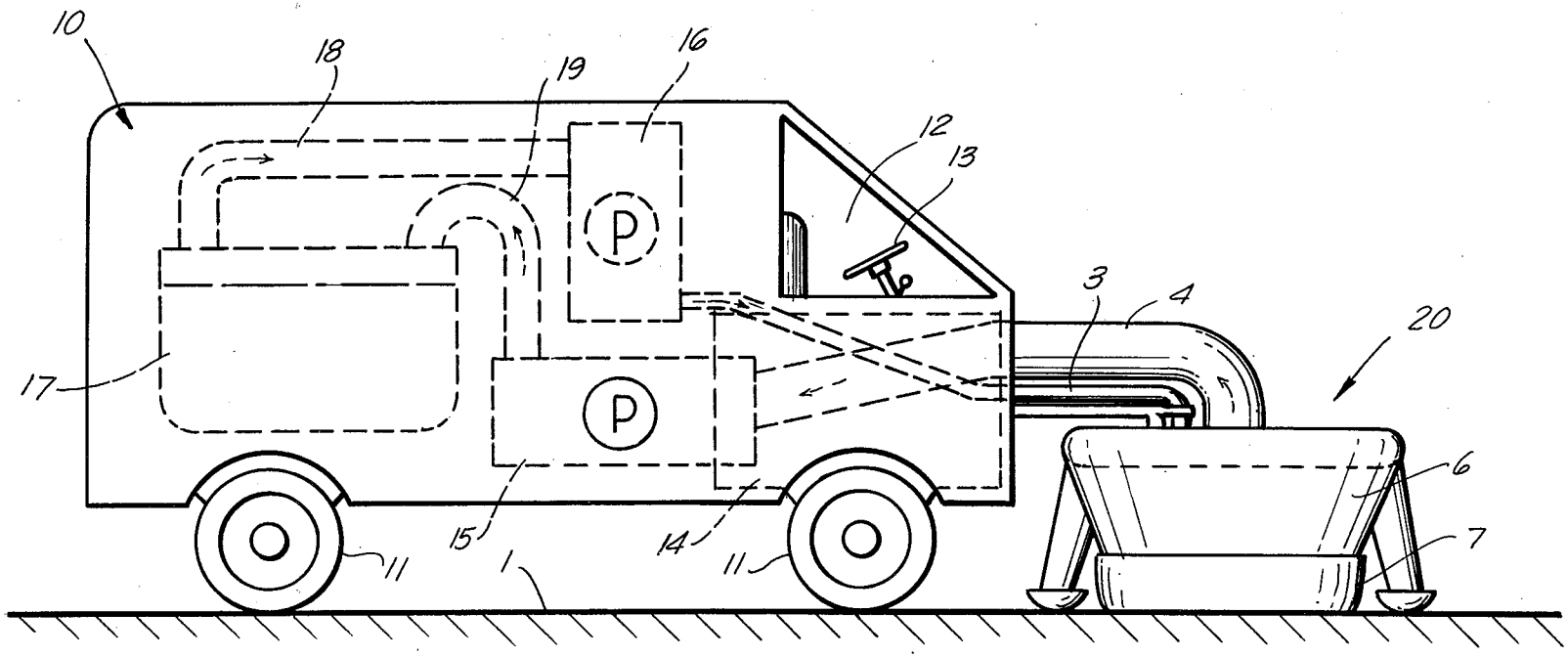
FIG. 3 is a vertical elevational view of a vehicle provided with the apparatus of the present invention.

FIG. 3 shows the apparatus 20 of FIGS. 1 and 2 to be mounted upon a support at the forward end of a vehicle which is represented generally at 10 and is propelled along the surface 1 by wheels 11 driven in the usual manner by an engine 14. The vehicle can be steered by a steering wheel 13 from the operators cab 12.

Within the body of the vehicle, there can be provided a suction pump 15 which is connected to the duct 4 and is driven by the engine 14. The suction pump 15 discharges via a duct 19 into the collecting and filtering tank 17 from which clarified water is drawn by a duct 18 and forced by a high-pressure pump 16 to the nozzles 3.

The collecting nozzle 5 is, as can be seen in FIG. 2, of hexagonal plan configuration and advantageously, each side of this nozzle is provided with a respective nozzle 3 whose jet has a spread which is less than the length of the corresponding side of the hood 5.

I claim:

1. A surface-cleaning apparatus which comprises:
a downwardly open water-collecting duct;
a suction source connected to said duct;
means on an end of said duct forming a downwardly and outwardly flared collecting nozzle;
means for adjusting the position of said nozzle on said duct to thereby control the height of said nozzle above the surface to be cleaned;
an array of pressurized-water nozzles surrounding said duct for emitting downwardly and inwardly trained jets of water directed beneath said collecting nozzle and against said surface whereby dirty water reflected from said surface from said jets is drawn upwardly into said duct;
a manifold surrounding said duct and connected with a source of water under pressure; and
cardan-joint means swingably connecting each pressurized water nozzle to said manifold to train the respective jet at an adjustable angle to said surface.

2. The apparatus defined in claim 1 the axes of said jets include with said surface an angle adjustable between 30° and 75°.

3. The apparatus defined in claim 2 wherein said pressurized-water nozzles are equispaced about said duct and train the respective jets beneath said collecting nozzle.

4. The apparatus defined in claim 3, further comprising a hood surrounding said collecting nozzle and said pressurized-water nozzles, said hood reaching downwardly toward said surface and being provided with elastic sealing strips engageable with said surface.

5. The apparatus defined in claim 1, further comprising legs supporting said manifold and said hood upon said surface.

6. The apparatus defined in claim 4, further comprising a vehicle carrying said duct, said collecting nozzle and said pressurized-water nozzles, said vehicle being formed with a high-pressure water pump connected to said manifold.

7. The apparatus defined in claim 6 wherein said vehicle is provided with a collecting tank for dirt separated from the water picked up by said duct.

8. The apparatus defined in claim 7 wherein said collecting nozzle is of polygonal configuration, each side of said collecting nozzle being juxtaposed with a respective pressurized-water nozzle.

* * * * *